US010590844B2

(12) United States Patent
Vogel et al.

(10) Patent No.: US 10,590,844 B2
(45) Date of Patent: Mar. 17, 2020

(54) INTERNAL COMBUSTION ENGINE

(71) Applicant: GM GLOBAL TECHNOLOGY OPERATIONS LLC, Detroit, MI (US)

(72) Inventors: Stefan Vogel, Mainz (DE); Stefan Lindner, Friesenheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/032,815

(22) Filed: Jul. 11, 2018

(65) Prior Publication Data

US 2019/0017434 A1 Jan. 17, 2019

(30) Foreign Application Priority Data

Jul. 11, 2017 (DE) ..... 10 2017 006 559

(51) Int. Cl.

| | |
|---|---|
| ***F02B 75/04*** | (2006.01) |
| ***F01L 1/344*** | (2006.01) |
| ***F02D 15/02*** | (2006.01) |
| ***F02B 41/04*** | (2006.01) |

(52) U.S. Cl.

CPC ..... *F02B 75/048* (2013.01); *F01L 1/344* (2013.01); *F02B 41/04* (2013.01); *F02B 75/045* (2013.01); *F02D 15/02* (2013.01)

(58) Field of Classification Search

CPC ..... F02B 75/048; F02B 41/04; F02B 75/045; F01L 1/344; F02D 15/02

See application file for complete search history.

(56) References Cited

U.S. PATENT DOCUMENTS

2001/0053329 A1* 12/2001 Fledersbacher ..... F01D 25/166 417/407
2007/0044739 A1* 3/2007 Clarke ..... F01B 9/02 123/78 F
2013/0092114 A1* 4/2013 Pietsch ..... F01L 1/34 123/90.17
2014/0137825 A1* 5/2014 Brendel ..... F16F 15/264 123/90.17

FOREIGN PATENT DOCUMENTS

DE 102010004588 A1 9/2011

* cited by examiner

*Primary Examiner* — Jacob M Amick
*Assistant Examiner* — Charles Brauch
(74) *Attorney, Agent, or Firm* — Lorenz & Kopf, LLP

(57) ABSTRACT

An internal combustion engine for a motor vehicle included a crankshaft, at least one piston coupled to the crankshaft for performing strokes in a cylinder as a consequence of a rotation of the crankshaft. An eccentric shaft is coupled to the crankshaft and to the piston in such a manner that through it strokes of the piston are extendable. The internal combustion engine further includes a phase adjuster for adjusting a phase of the coupling of the eccentric shaft to the crankshaft and/or a stroke adjuster for adjusting strokes of the piston, in particular an extension of strokes of the piston by the eccentric shaft.

19 Claims, 2 Drawing Sheets

INTERNAL COMBUSTION ENGINE

CROSS-REFERENCE TO RELATED APPLICATION

This application claims priority to German Patent Application No. 102017006559.4, filed Jul. 11, 2017, which is incorporated herein by reference in its entirety.

TECHNICAL FIELD

The present disclosure relates to an internal combustion engine, in particular for a motor vehicle, to a motor vehicle, in particular a passenger car, with the internal combustion engine and to a method for operating the internal combustion engine.

BACKGROUND

DE 10 2010 004 588 A1 discloses an internal combustion engine with a crankshaft and an eccentric shaft, which for extending an expansion stroke of pistons of the internal combustion engine is connected by connecting rods and coupling links to the crankshaft and which is simultaneously driven by the crankshaft with half the rotational speed of the crankshaft via a spur gearing in order to increase the expansion and exhaust stroke, i.e. the piston stroke during the expansion and exhaust cycle relative to the intake and compression stroke, i.e. the piston stroke during the intake and compression cycle.

There is a need in the art to further improve an internal combustion engine, in particular such an internal combustion engine, or its operation as is disclosed in DE 10 2010 004 588 A1, which is incorporated herein by reference in its entirety.

SUMMARY

According to an embodiment of the present disclosure, an internal combustion engine for a motor vehicle, in particular of a passenger car, includes a crankshaft, at least one piston, coupled to the crankshaft for performing reciprocating strokes in a cylinder as a consequence of a rotation of the crankshaft, and an eccentric shaft, which is coupled to the crankshaft and to the piston in such a manner that strokes of this piston are extendable by way of said eccentric shaft, in particular are extended at least temporarily or in at least one operating state.

In an embodiment, the piston, as a consequence of the rotation of the crankshaft, performs consecutive cycles in the cylinder consisting of an intake (downward) stroke, a subsequent compression (upward) stroke, a subsequent expansion (downward) stroke and a subsequent exhaust (upward) stroke. Here, an extension of a stroke in particular in technical terms is to mean the increase of a stroke or piston travel between an upper and a lower end point, which define or delimit the stroke or piston travel.

According to an aspect of the present disclosure, a phase of the coupling of the eccentric shaft to the crankshaft or the coupling between the eccentric shaft and the crankshaft is adjusted by a phase adjuster. The internal combustion engine according to an embodiment of the present disclosure includes a phase adjuster by way of which a phase of the coupling of the eccentric shaft to the crankshaft or the coupling between the eccentric shaft and the crankshaft is adjustable and may be adjusted.

Because of this, an additional (control) degree of freedom can be made available or utilized in an embodiment, in particular a ratio of in strokes within the individual cycles relative to one another or among one another, in particular a ratio between a compression and a subsequent expansion stroke and thus a ratio between a compression and an expansion ratio of the cylinder, can be advantageously varied, in particular adapted corresponding to an operating state of the internal combustion engine, and an operating behavior of the internal combustion engine thereby resulting in an improved internal combustion engine.

According to a further aspect of the present disclosure, which in an embodiment is advantageously combined with the aspect of a phase adjustment described here or a phase adjuster described here and in another embodiment is embodied or formed without the same or independently, strokes of the piston (in addition or alternatively to the aspect of a phase adjustment described here or of a phase adjuster described here), in an embodiment, the extension of strokes of the piston by the eccentric shaft, are adjusted by a stroke adjuster. Accordingly, the internal combustion engine, according to an embodiment of the present disclosure, includes a stroke adjuster by way of which the strokes of the piston, in particular the extension of strokes of the piston by the eccentric shaft are/is adjustable and may be is adjusted. At the same time, the aspect of a phase adjustment or of a phase adjuster described here can also be embodied or formed by the stroke adjuster in an embodiment independently or without an adjustment of strokes of the pistons described here, in particular of the extension of strokes of the piston by the eccentric shaft.

By way of such an adjustment of strokes of the piston, in particular of the extension of strokes of the piston by the eccentric shaft, an additional (control) degree of freedom can be provided or utilized in an embodiment, a ratio of in particular consecutive strokes within the individual cycles relative to one another or among one another and/or a ratio of same types of strokes be advantageously varied in different, in particular consecutive cycles relative to one another or among one another, in particular a ratio between a compression and a subsequent expansion stroke in different cycles and/or a ratio between compression, expansion, exhaust and/or intake strokes of different cycles, in particular an operating state of the internal combustion engine adapted and thereby in an embodiment an operating behavior of the internal combustion engine improved. Here, by combining phase and stroke (extension) adjustment the internal combustion engine in an embodiment can be flexibly adapted to different operating conditions.

In an embodiment, the eccentric shaft is coupled to the crankshaft and the piston in such a manner that through it certain strokes of a cycle are extendable relative to other strokes of the cycle, in particular steplessly or continuously and/or depending on the position of the phase adjuster. In particular expansion strokes may be adjustable relative to compression and/or exhaust strokes, in particular expansion strokes optionally or depending on the position of the phase adjuster, extendable relative to compression or to exhaust strokes.

Additionally or alternatively, the eccentric shaft in an embodiment is coupled to the crankshaft and the piston in such a manner that through it certain strokes of a cycle are extendable relative to the same (types) of strokes of another cycle, in particular steplessly or continuously and/or depending on the position of the stroke adjuster.

In an embodiment, the eccentric shaft, in particular in addition to the coupling to the one or more pistons of the internal combustion engine via the crankshaft is coupled to the crankshaft in such a manner, in particular mechanically, that it rotates in a certain rotational speed ratio with or relative to the same, in particular with half the rotational speed of the crankshaft, and/or with a phase that is adjustable by the phase adjuster or constant relative to the same, in particular driven by the same. A phase in an embodiment, as is customary according to the state of the art, depends on a distance between (the reaching) of an in particular given reference (angle) position of the crankshaft and (the, in particular following or preceding reaching) of an in particular given reference (angle) position of the eccentric shaft, in particular indicates the same. In an embodiment, the crankshaft and the eccentric shaft are rotatably mounted about axes of rotation that are offset parallel to one another, in particular in a one or multiple-part housing of the internal combustion engine.

In an embodiment, the internal combustion engine includes at least one second piston which is coupled to the crankshaft for performing strokes in a second cylinder as a consequence of the rotation of the crankshaft or in such a manner that it performs strokes in a second cylinder as a consequence of a rotation of the crankshaft, in particular consecutive cycles of an intake (downward) stroke, a subsequent compression (upward) stroke, a subsequent expansion (downward) stroke and a subsequent exhaust (upward) stroke.

In an embodiment, the eccentric shaft is coupled to the crankshaft and, in a further development in addition to its coupling with adjustable phase to the crankshaft and/or via the crankshaft to the second piston in such a manner that through it strokes (also) of this second piston, in particular certain strokes of a cycle are extendable relative to other strokes of the cycle, in particular expansion strokes relative to compression and/or exhaust strokes, in particular optionally or depending on the position of the phase adjuster, relative to compression or exhaust strokes.

By way of this, a ratio of in particular consecutive strokes within the individual cycles relative to one another or among one another, in particular a ratio between a compression and a subsequent expansion stroke and thus a ratio between a compression and an expansion ratio of the respective cylinder can be advantageously, in particular homogeneously varied, in particular adapted corresponding to an operating state of the internal combustion engine and by way of this an operating behavior of the internal combustion engine further improved in an embodiment.

Additionally or alternatively, the eccentric shaft, in an embodiment, is coupled to the crankshaft and, in a further development additionally to its coupling with adjustable phase to the crankshaft and/or via the crankshaft, to the second piston in such a manner that through it strokes (also) of this second piston, in particular the extension of strokes of this second piston, are adjustable, in particular extendable optionally or depending on the position of a second stroke adjuster.

By way of this, in an embodiment for multiple cylinders, a ratio of in particular consecutive strokes within the individual cycles relative to or among one another and/or a ratio of in particular same types of strokes in different, in particular consecutive cycles relative to or among one another, in particular a ratio between a compression and a subsequent expansions stroke in different cycles and/or a ratio between compression, expansion, exhaust and/or intake strokes of different cycles, can be advantageously varied, in particular adapted according to an operating state of the internal combustion engine and because of this an operating behavior of the internal combustion engine improved in an embodiment.

In an embodiment, the crankshaft, the eccentric shaft and the at least one piston, in particular in addition to the coupling of the eccentric shaft to the crankshaft that is phase-adjustable in an embodiment, are coupled by a (first) crank drive, in particular a multi joint crank drive which, in particular its transmission ratio, is adjustable or adjusted by the stroke adjuster in an embodiment. In a further development the crankshaft, the eccentric shaft and the at least one second piston is adjustable or adjusted by a second crank drive, which, in particular its transmission ratio, is adjustable or adjusted by the second stroke adjuster in an embodiment. In an embodiment, the eccentric shaft and/or the at least one piston is/are (each) coupled by a connecting rod to a coupling link that is common and/or coupled to the crankshaft, in particular of the crank drive, in an embodiment adjustable by the stroke adjuster. In a further development, the eccentric shaft and/or the at least one second piston is/are in particular (each) coupled by a connecting rod to a second coupling link that is in particular common and/or coupled to the crankshaft, in particular of the second crank drive, in particular adjustable by the second stroke adjuster.

Because of this, the mechanical coupling in an embodiment can be improved, in particular realized in a particularly compact, reliable and/or precise manner.

In an embodiment, an (effective) length of the connecting rod coupled to the eccentric shaft of the one (first) crank drive or a distance between its connecting points to eccentric shaft and coupling link is adjustable or adjusted by the stroke adjuster or the internal combustion engine, in particular the stroke adjuster, equipped for this purpose.

Additionally or alternatively, a connection of the connecting rod of the one (first) crank drive is coupled to the eccentric shaft, in particular a fulcrum or radius of the eccentric shaft, in which connecting rod and eccentric shaft are connected to one another, is adjustable or adjusted by the stroke adjuster, in particular shiftable or shifted in particular on the eccentric shaft and/or on the connecting rod, or the internal combustion engine, in particular the stroke adjuster, equipped for this purpose.

Additionally or alternatively, a connection of this connecting rod coupled to the eccentric shaft of the one (first) crank drive to the coupling link, in particular a fulcrum or radius of the coupling link, in which connecting rod and coupling link are connected to one another, is adjustable or adjusted by the stroke adjuster in particular shiftable or shifted in particular on the coupling link and/or on the connecting rod, or the internal combustion engine, in particular the stroke adjuster, equipped for this purpose.

Additionally or alternatively, an (effective) length of the connecting rod of the one (first) crank drive that is coupled to the at least one piston or a distance between its connecting points on piston and coupling link is adjustable or adjusted by the stroke adjuster in an embodiment or the internal combustion engine, in particular the stroke adjuster equipped for this purpose.

Additionally or alternatively, a connection of the connecting rod of the one (first) crank drive that is coupled to the at least one piston to the coupling link, in particular a fulcrum or radius of the coupling link, in which the connecting rod and coupling link are connected to one another, and/or a connection of this connecting rod to the at least one piston, in particular a fulcrum of the connecting rod, in which connecting rod and piston are connected to one another, is adjustable or adjusted in an embodiment, in particular shiftable or shifted on the coupling link or piston and/or the connecting rod, or the internal combustion engine, in particular the stroke adjuster, equipped for this purpose.

Additionally or alternatively, an (effective) length of the coupling link of the one (first) crank drive or a distance between its connecting points on the two connecting rods is adjustable or adjusted in an embodiment by the stroke adjuster or the internal combustion engine, in particular the stroke adjuster, equipped for this purpose.

In an embodiment, an (effective) length of the connecting rod of the second crank drive coupled to the eccentric shaft or a distance between its connecting points on eccentric shaft and second coupling link is adjustable or adjusted by the second stroke adjuster or the internal combustion engine, in particular the second stroke adjuster, equipped for this purpose.

Additionally or alternatively, a connection of the connecting rod of the second crank drive that is coupled to the eccentric shaft to the eccentric shaft is adjustable or adjusted by the second stroke adjuster on the eccentric shaft, in particular a fulcrum or radius of the eccentric shaft, in which the connecting rod and eccentric shaft are connected to one another, in particular shiftable or shifted on the eccentric shaft and/or the connecting rod, or the internal combustion engine, in particular the second stroke adjuster, equipped for this purpose.

Additionally or alternatively, a connection of this connecting rod of the second crank drive that is coupled to the eccentric shaft to the eccentric shaft is adjustable or adjusted by the second stroke adjuster on the coupling link, in particular a fulcrum or radius of the coupling link, in which the connecting rod and coupling link are connected to one another, in particular shiftable or shifted on the coupling link and/or the connecting rod or the internal combustion engine, in particular the second stroke adjuster, equipped for this purpose.

Additionally or alternatively, an (effective) length of the connecting rod of the second crank drive that is coupled to the at least one second piston or a distance between its connecting points on the second piston and coupling link is adjustable or adjusted by the second stroke adjuster in an embodiment, or the internal combustion engine, in particular the second stroke adjuster, is equipped for this purpose.

Additionally or alternatively, a connection of the connecting rod of the second crank drive coupled to the at least one second piston to the coupling link is adjustable or adjusted by the second stroke adjuster on the coupling link, in particular a fulcrum or radius of the coupling link, in which the connecting rod and coupling link are connected to one another, and/or a connection of this connecting rod to the at least one second piston, in particular a fulcrum of the connecting rod, in which the connecting rod and piston are connected to one another, is adjustable or adjusted by the second stroke adjuster, in particular shiftable or shifted on the coupling link or second piston and/or connecting rod, or the internal combustion engine, in particular the second stroke adjuster, equipped for this purpose.

Additionally or alternatively, an (effective) length of the coupling link of the second crank drive or a distance between its connecting points on the two connecting rods is adjustable or adjusted by the second stroke adjuster in an embodiment, or the internal combustion engine, in particular the second stroke adjuster, equipped for this purpose.

Because of this, a mechanically, kinematically and/or control-technically advantageous adjustment of the strokes of the at least one or second piston, in particular the extension of strokes of this piston, can be realized in each case by the eccentric shaft in an embodiment. Here, an adjustment, in particular shifting, of the connection of the connecting rod of a crank drive on the eccentric shaft or the adjustment of the corresponding radius in an embodiment, can be mechanically, kinematically and/or control-technically particularly advantageous.

In an embodiment the eccentric shaft, in a position of the phase adjuster, extends expansion and/or exhaust strokes of the at least one piston relative to the intake and/or compression strokes of this piston by an amount and in at least one second position of the phase adjuster, expansion and/or exhaust strokes of this piston relative to intake and/or compression strokes of this piston by another amount that is greater than the one amount, in particular in a first position of the phase adjuster, expansion and/or exhaust strokes of the at least on piston relative to the intake and/or compression strokes of this piston by a first amount and in a second position of the phase adjuster, expansion and/or exhaust strokes of this piston relative to intake and/or compression strokes of this piston by a second amount that is greater than the first amount or is equipped or used for this purpose.

In a further development, the eccentric shaft in the one position of the phase adjuster (also) extends expansion and/or exhaust strokes of the at least one second piston relative to the intake and/or compression strokes of this piston by an, in particular this, amount and in the at least one second position of the phase adjuster, (also) expansion and/or exhaust strokes of this piston relative to the intake and/or compression strokes of this piston by another in particular this one other amount that is greater than this one amount in particular in the first position of the phase adjuster, expansion and/or exhaust strokes of the at least one second piston relative to the intake and/or compression strokes of this piston by the same or another first amount and in the second position of the phase adjuster, expansion and/or exhaust strokes of this piston relative to intake and/or compression strokes of this piston by the same or another second amount, which is greater than this first amount, or is equipped for this purpose or used for this purpose.

Here, an expansion stroke is understood to mean a stroke of or in an expansion cycle of the internal combustion engine or of a combustion-driven volume-enlarging movement of the piston in the cylinder, an exhaust stroke accordingly in particular a stroke, in particular in opposite direction thereto, of a or in a, in particular subsequent exhaust cycle of the internal combustion engine or a volume-reducing movement of the piston in the cylinder for pushing out exhaust gas, an intake stroke accordingly in particular a stroke in particular in opposite direction thereto, of a or in an in particular subsequent intake cycle of the internal combustion engine or a volume-enlarging movement of the piston in the cylinder for sucking in combustion air or a combustion air mixture, a compression stroke accordingly in particular a stroke, in particular in opposite direction thereto, of a or in a, in particular subsequent compression cycle of the internal combustion engine or of a volume-reducing movement of the piston in the cylinder for compressing combustion air or a combustion air mixture.

Through a variable extension of expansion and/or exhaust strokes relative to intake and/or compression strokes, a variable Atkinson cycle process can be realized in an embodiment and by way of this in a further development, exhaust gas more greatly expanded and/or cooled and because of this the energy contained in the gas better utilized and/or the cylinder better scavenged and thus an operating behavior of the internal combustion engine further improved.

Additionally or alternatively, the eccentric shaft in an embodiment, in a position of the phase adjuster, extends compression and/or expansion strokes of the at least one piston relative to the intake and/or exhaust strokes of this piston by an amount and in at least one second position of the phase adjuster, compression and/or expansion strokes of this piston relative to intake and/or exhaust strokes of this piston by another amount that is greater than the one amount, in particular in a (further) first position of the phase adjuster, compression and/or expansion strokes of the at least one piston relative to intake and/or exhaust strokes of this piston by a first amount and in a (further) second position of the phase adjuster, compression and/or expansion strokes of this piston relative to intake and/or exhaust strokes of this piston by a second amount which is greater than this first amount or is equipped for this purpose or used for this purpose.

In a further development, the eccentric shaft in this one position of the phase adjuster, (also) extends compression and/or expansion strokes of the at least one second piston relative to intake and/or exhaust strokes of this piston by an amount and in this at least one further position of the phase adjuster, compression and/or expansion strokes of this piston relative to intake and/or exhaust strokes of this piston by another amount which is greater than this one amount, in particular in the (further) first position of the phase adjuster, compression and/or expansion strokes of the at least one second piston relative to intake and/or exhaust strokes of this piston by the same or another first amount and in the (further) second position of the phase adjuster, compression and/or expansion strokes of the at least one second piston relative to intake and/or exhaust strokes of this piston, by the same or another second amount which is greater than this first amount or is equipped for this purpose or used for this purpose.

By a variable extension of compression and/or expansion strokes relative to intake and/or exhaust strokes, a variable inverted Atkinson cycle process can be realized in an embodiment and by way of this in a further development, combustion air or combustion air mixture more greatly compressed and because of this the power increased and thereby an operating behavior of the internal combustion engine further improved, in particular in the case that a charging means, in particular a turbocharger, does not yet supply any or a low charge pressure. In an embodiment, a starting process, an efficiency, in particular at low loads or in part load ranges, a power density and/or a transient behavior, in particular response behavior of the internal combustion engine can be improved by a variable inverted Atkinson cycle process.

Additionally or alternatively, the eccentric shaft in an embodiment, in a position of the phase adjuster, extends expansion and/or exhaust strokes of the at least one piston relative to intake and/or compression strokes of this piston and in at least one further position of the phase adjuster, compression and/or expansion strokes of this piston relative to intake and/or exhaust strokes of this piston, in particular in the first position of the phase adjuster, expansion and/or exhaust strokes of the at least one piston relative to intake and/or compression strokes of this piston and in the further first position of the phase adjuster, compression and/or expansion strokes of this piston relative to intake and/or exhaust strokes of this piston, or is equipped for this purpose or used for this purpose.

In a further development, the eccentric shaft, in the one position of the phase adjuster, (also) extends expansion and/or exhaust strokes of the at least one second piston relative to intake and/or compression strokes of this piston and in the at least one second position of the second adjuster, compression and/or expansion strokes of this piston relative to intake and/or exhaust strokes of this second piston, in particular in the first position of the phase adjuster, expansion and/or exhaust strokes of the at least one second piston relative to intake and/or compression strokes of this piston and in the further first position of the phase adjuster, compression and/or expansion strokes of this piston relative to intake and/or exhaust strokes of this piston, or is equipped for this purpose or used for this purpose.

By way of this, it is optionally possible, in an embodiment, to change between an Atkinson cycle process and an inverted Atkinson cycle process and an operating behavior of the internal combustion engine can thereby be further improved.

Additionally or alternatively, the eccentric shaft in an embodiment, in a (neutral) position of the phase adjuster, reduces a deviation between expansion, exhaust, intake and compression strokes, in particular to a maximum of 50%, in particular to a maximum of 10%, in particular to a maximum of 1% of a maximum (possible or adjustable) deviation in particular—at least substantially or within the scope of a positioning accuracy—to zero or is equipped for this purpose or used for this purpose.

Because of this, an (inverted Atkinson cycle process or a regular cycle process), in particular auto or diesel cycle process, can be carried out or conducted in particular optionally in an embodiment without stroke extension(s), in a further development as a function of one or more operating parameters of the internal combustion engine, in particular an operating state, in particular a load range, a rotationally speed, a torque, a temperature and/or a charge pressure of the internal combustion engine, in particular of a charging means, in particular of at least one turbocharger. Because of this, an operating behavior of the internal combustion engine can be further improved in an embodiment.

In an embodiment, the stroke adjuster, in an embodiment, by means of the eccentric shaft, in particular by means of the (first) crank drive, in or at a first position of the stroke adjuster, extends expansion, exhaust, intake and/or compression strokes of the at least one piston relative to expansion, exhaust, intake and/or compression strokes in or at a second position of the stroke adjuster, in an embodiment in or at a first position of the stroke adjuster, expansion strokes relative to expansion strokes in or at a second position of the stroke adjuster and/or in or at the first position of the stroke adjuster, exhausts strokes relative to exhaust strokes in or at the second position of the stroke adjuster and/or in or at the first position of the stroke adjuster, intake strokes relative to intake strokes in or at the second position of the stroke adjuster and/or in or at the first position of the stroke adjuster, compression strokes relative to compression strokes in or at the second position of the stroke adjuster or the internal combustion engine, in particular the stroke adjuster, is equipped for this purpose.

In an embodiment, the stroke adjuster enlarges the extension of strokes of the at least one piston through the eccentric shaft in the first position of the stroke adjuster relative to an extension of strokes of the at least one piston by the eccentric shaft in the second position of the stroke adjuster or the internal combustion engine, in particular the stroke adjuster, is equipped for this purpose. In an embodiment, the second stroke adjuster, in an embodiment, extends by means of the eccentric shaft, in particular by means of the second crank drive, in or at a position of the second stoke adjuster, expansion, exhaust, intake and/or compression strokes of the at least one second piston relative to expansion, exhaust, intake and/or compression strokes in or at a further position of the second stroke adjuster, in an embodiment, in or at a first position of the second stroke adjuster, expansion strokes relative to expansion strokes in or at a second position of the second stroke adjuster and/or in or at the first position of the second stroke adjuster, exhaust strokes relative to exhaust strokes in or at the second position of the second stroke adjuster and/or in or at the first position of the second stroke adjuster, intake strokes relative to intake strokes in or at the second position of the second stroke adjuster and/or in or at the first position of the second stroke adjuster, compression strokes relative to compression strokes in or at the second position of the second stroke adjuster, or the internal combustion engine, in particular the second stroke adjuster is equipped for this purpose. In an embodiment, the second stroke adjuster enlarges the extension of strokes of the at least one second piston by the eccentric shaft in the first position of the second stroke adjuster relative to an extension of strokes of the at least one second piston by the eccentric shaft in the second position of the second stroke adjuster or the internal combustion engine, in particular the second stroke adjuster, is equipped for this purpose.

In an embodiment, the internal combustion engine includes a gearing which mechanically couples the eccentric shaft to the crank shaft, in particular additionally to the piston or pistons via the crank shaft, in particular in addition to the crank drive or crank drives, in particular in such a manner that the eccentric shaft rotates in a certain rotational speed ratio with or with respect to the crank shaft, in particular with half the rotational speed of the crank shaft, and/or with a phase that is adjustable by the phase adjuster in an embodiment, relative to the same, in particular is driven by the same, or which is equipped for this purpose or used for this purpose.

In a further development, the transmission includes a first and a second transmission link, the phase offset of which relative to the first transmission link is adjustable or adjusted by the phase adjuster for adjusting the phase of the coupling of the eccentric shaft to the crankshaft or is equipped for this purpose or used for this purpose, wherein a phase offset in an embodiment depends, in a manner that is customary according to the state of the art, on a distance between (the reaching) of an in particular given reference (angle) position of the first transmission link and (the, in particular following or preceding reaching) of a, in particular given, reference (angle) position of the second transmission link, in particular indicates the same.

By way of this, the mechanical coupling and/or its phase adjustment can be improved in an embodiment, in particular realized in a compact, reliable and/or precise manner.

In a further development, the transmission can include in particular be a gear (wheel) transmission and/or a, in particular frictionally engaged and/or positively engaged traction drive transmission, in particular pushing or pulling chain traction drives and/or belt drives.

Because of this, the mechanical coupling can be improved in an embodiment, in particular realized in a compact, reliable and/or precise manner.

In an embodiment, the phase adjuster operates hydraulically and/or electrically, in particular electromagnetically and/or electromotorically, and/or is hydraulically and/or electrically, in particular electromagnetically and/or electromotorically actuated and/or controlled or is a hydraulic and/or electric phase adjuster. Additionally or alternatively, the stroke adjuster and/or the second stroke adjuster in an embodiment works hydraulically and/or electrically, in particular electromagnetically and/or electromotorically, and/or is hydraulically and/or electrically, in particular electromagnetically and/or electromotorically actuated and/or controlled or is a hydraulic and/or electric (second) stroke adjuster.

By way of this, the phase adjustment of the coupling and/or the adjustment of strokes, in particular the extension of strokes through the eccentric shaft can be improved in an embodiment, in particular realized in a compact, reliable and/or precise manner.

In an embodiment, the internal combustion engine includes a supercharging means, in particular at least one turbocharger, for the supercharged filling of the at least one cylinder, in a further development, also for the supercharged filling of the at least one second cylinder.

In particular in the case of supercharged internal combustion engines, an inverted Atkinson cycle process can advantageously increase the pressure of the combustion air or of the combustion air mixture in phases of absent or low pressure charging and thus improve the operation of the internal combustion engine.

In an embodiment, the phase of the coupling of the eccentric shaft to the crankshaft is adjusted by the phase adjuster and/or strokes of the at least one piston, in particular the extension of strokes of the at least on piston by the eccentric shaft, by the stroke adjuster and/or strokes of the at least one second piston, in particular the extension of strokes of the at least one second piston by the eccentric shaft, by the second stroke adjuster (in each case) as a function of one or more, in an embodiment the same operating parameters of the internal combustion engines, in particular an operating state, in particular a load range, a rotational speed, a torque, a temperature and/or a charge pressure of the internal combustion engine, in particular a charging means, in particular at least one turbocharger, or the phase and/or stroke and/or second stroke adjusters suitably controlled. Accordingly, the internal combustion engine in an embodiment includes a controller which, in particular hardware and/or software-technically is equipped or used for this purpose or for controlling the phase adjuster for adjusting the phase of the coupling of the eccentric shaft to the crank shaft and/or the stroke adjuster for adjusting strokes of the at least one piston, in particular the extension of strokes of the at least one piston by the eccentric shaft, and/or of the second stroke adjuster for adjusting strokes of the at least one second piston, in particular the extension of strokes of the at least one second piston by the eccentric shaft (in each case) as a function of one or more operating parameters of the internal combustion engine, in particular an operating state, in particular a load range, a rotational speed, a torque, a temperature and/or a charge pressure of the internal combustion engine, in particular a charging means, in particular at least one turbocharger.

By way of this, strokes and/or their ratio can be advantageously varied in an embodiment, in particular (adapted) (corresponding) to an operating state of the internal combustion engine and by way of this, in an embodiment, an operating behavior of the internal combustion engine further improved.

A means in terms of the present disclosure can be formed by hardware and/or software, in particular include an in particular digital processing unit, in particular microprocessor unit (CPU) that is data or signal-connected to a storage and/or bus system and/or one or more programs or program modules. The CPU can be designed in order to execute commands which are implemented as a program stored in a storage system, to gather input signals from a data bus and/or emit output signals to a data bus. A storage system can include one or more in particular different storage media, in particular optical, magnetic, solid-state and/or other non-volatile media. The program can be of such a type that it embodies or is capable of carrying out the methods described here, so that the CPU can carry out the steps of such methods and thus operate, in particular control the internal combustion engine, in particular the phase and/or stroke and/or second stroke adjusters of the same.

In addition, other objects, desirable features and characteristics will become apparent from the subsequent summary and detailed description, and the appended claims, taken in conjunction with the accompanying drawings and this background.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
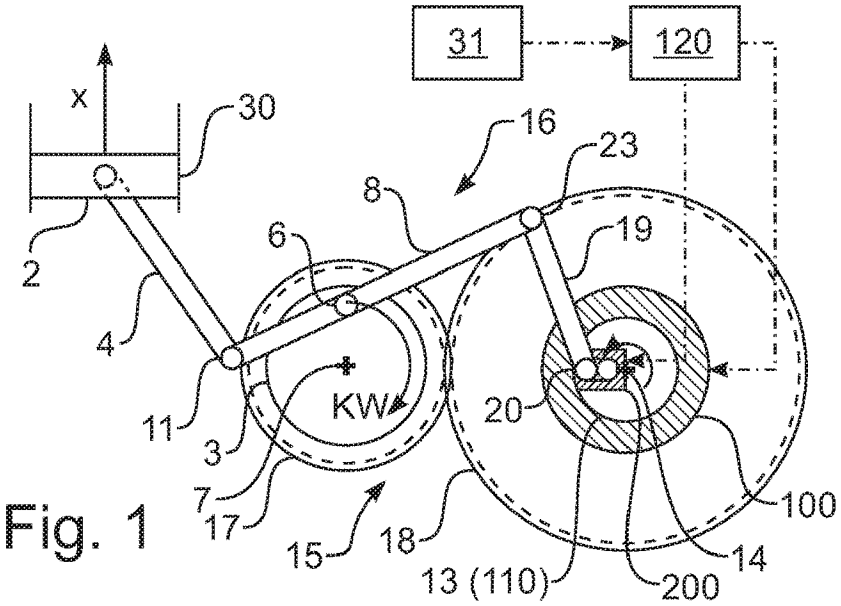
FIG. 1 illustrates a part of an internal combustion engine according to an embodiment of the present disclosure with a phase adjuster in a first position and a stroke adjuster in a first position.

FIG. 1 shows a part of an internal combustion engine according to an embodiment of the present disclosure.

The same includes a crankshaft 3 that is rotatably mounted about an axis of rotation 7, multiple, for example four, six, eight, ten or twelve pistons, of which in FIG. 1 only one piston 2 is exemplarily shown for the sake of clarity, and an eccentric shaft 13 that is rotatably mounted about an axis of rotation 14. The axes of rotation 7, 14 are offset parallel to one another. The pistons are identical in construction and function, so that in the following only the exemplarily shown piston 2 is explained and reference in this regard is made to the second pistons which are not shown. Complementarily, reference is also made to DE 10 2010 004 588 A1 mentioned at the outset. For this purpose, their reference characters are partly taken over.

The eccentric shaft 13 is coupled via a gear transmission 15, which includes a gearwheel 17 that is rotationally fixed to the crankshaft 3 and a gearwheel 18 meshing therewith with double the number of teeth, which is coupled to an output 110 of the gear transmission 15 that is rotationally fixed to the eccentric shaft 13 via a phase adjuster 100, by way of which in a manner known per se, for example from camshaft adjustments, a phase of the coupling of the eccentric shaft 13 to the crankshaft 3 is adjustable or adjusted.

The piston 2 is coupled to the crankshaft 3 for performing strokes in a cylinder 30 as a consequence of a rotation of the crankshaft through a crank drive 16, through which certain strokes are extendable within a cycle of intake, compression, expansion and exhaust stroke.

For this purpose, the crank drive 16 includes a common coupling link 8 which is mounted on the crankshaft 3 in a crankpin joint 6 that is eccentric to the axis of rotation 7 and coupled to the piston 2 by a first (piston) connecting rod 4 that is mounted on the coupling link 8 in a rotary joint 11. A second (steering) connecting rod 19 is connected to the eccentric shaft 13 in a rotary joint 20 that is eccentric relative to the axis of rotation 14 and to the coupling link 8 in a rotary joint 23.

In the exemplary embodiment, the rotary joint 20 or the connection, in which eccentric shaft 13 and second connecting rod 19 are coupled or connected to one another, is shiftable by a stroke adjuster 200 on the eccentric shaft 13 or the radius of the eccentric shaft 13, in which the same is connected to the second connecting rod 19, adjustable. This can in particular facilitate controlling or actuating the stroke adjuster 200. In modifications which are not shown, the rotary joint 20 can be additionally or alternatively shiftable or shifted on the second connecting rod 19 and/or the rotary joint 23 on the second connecting rod 19 and/or the coupling link 8 and/or the rotary joint 11 on the coupling link 8 and/or the first connecting rod 4 and/or the connection on the piston 2 by the stroke adjuster 200 of the same.

By way of this, strokes of the piston 2, in particular their extension by the eccentric shaft 13, are adjustable. A motor ECU 120 contains data among others of a turbocharger 31 for the supercharged filling of the cylinders 30 and controls the phase adjuster 100 and the stroke adjuster 200 as indicated by dash-dotted signal arrows in FIG. 1.

In the following, making reference to FIG. 1-4, only one phase adjustment according to an aspect of the present disclosure is initially explained, wherein the stroke adjuster 200 is kept constant in its first position shown in FIG. 1, 2. Accordingly, the stroke adjuster 200 can also be omitted or rotary joint 20 or the connection of the second connecting rod 19 to the eccentric shaft 13 can be constant or fixed in place relative to second connecting rod 19 and eccentric shaft 13 in a modification which is not shown.

Figure 5:
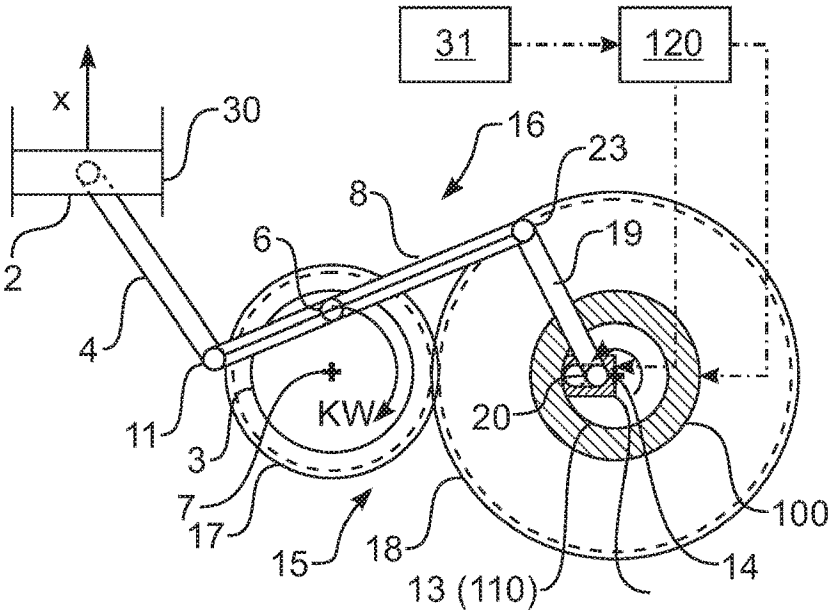
FIG. 5 illustrates the internal combustion engine with the phase adjuster in the first position of FIG. 1 and the stroke adjuster in a further position.

Following this, making reference to FIG. 1, 5-7, only one stroke adjustment according to a further aspect of the present disclosure is separately explained, wherein conversely the phase adjuster 100 is kept constant in its first position shown in FIG. 1, 5. Accordingly, the phase adjuster 100 can also be omitted in a modification which is not shown.

In an embodiment, phase adjustment and stroke adjustment are combined with one another, wherein their separate explanation with reference to FIG. 1-4 on the one hand (phase adjustment) and FIG. 1, 5-7 on the other hand (stroke adjustment) merely serves for a more compact representation.

Figure 3:
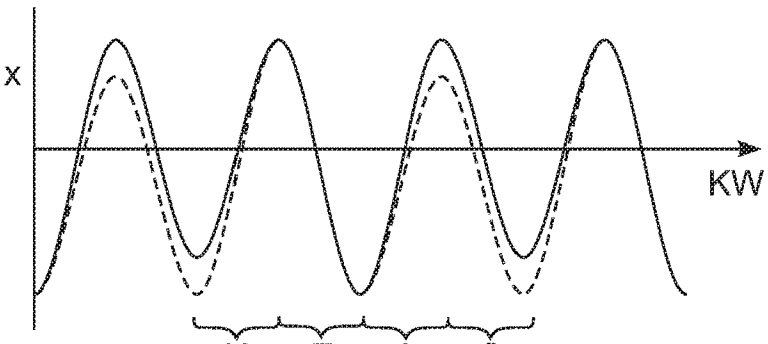
FIG. 3 is a graph showing strokes of a piston of the internal combustion engine in the first position the further first position of the phase adjuster and the first position of the stroke adjuster.

In a first position S10 (see FIG. 4) of the phase adjuster 100 indicated in FIG. 1, the eccentric shaft 13 extends expansion strokes in expansion cycles E and exhaust strokes in exhaust cycles A relative to intake strokes in intake cycles S and compression strokes in compression cycles K as indicated in FIG. 3 in an expanded manner, in which the movement x of the piston 2 is indicated over the crankshaft angle KW of the crankshaft 3, thus realizing an Atkinson cycle process.

Figure 2:
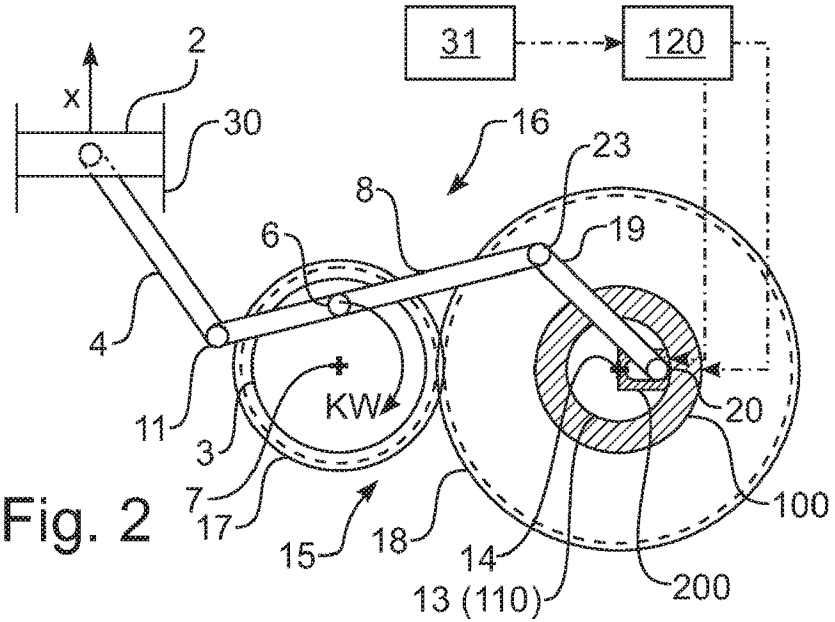
FIG. 2 illustrates the internal combustion engine with the phase adjuster in a further first position and the stroke adjuster in the first position.

As a function of at least one operating parameter of the internal combustion engine, for example in the case that a charge pressure of the turbocharger 31 falls below a given limit amount, the ECU 120 steers the phase adjuster 100 into a further first position S100 (see FIG. 4), which is indicated in FIG. 2. In this further first position of the phase adjuster 100, the eccentric shaft 13 now extends the expansion strokes in the expansion cycles E and the compression strokes in the compression cycles K relative to the intake strokes in the intake cycles S and the exhaust strokes in the exhaust cycles A, as is indicated with dashed lines in FIG. 3 thus realizing an inverted Atkinson cycle process.

Figure 4:
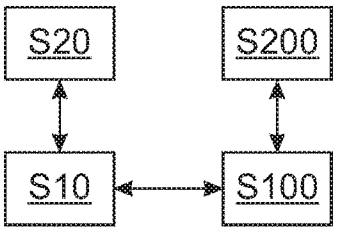
FIG. 4 is a flow chart showing a method for operating the internal combustion engine according to an embodiment of the present disclosure.

As a function of the at least one operating parameter of the internal combustion engine, the ECU 120 again steers the phase adjuster 100 into the one first position S10 (see FIG. 4).

Additionally or alternatively, the ECU 100 controls the phase adjuster 100, as a function of at least one operating parameter, for example a load range of the internal combustion engine, starting out from the first position S10 shown in FIG. 1 into a further position S20 (see FIG. 4), in which the eccentric shaft 13 extends the expansion and exhaust strokes relative to the intake and compression strokes by a greater amount.

Additionally or alternatively, the ECU 120 controls the phase adjuster 100, as a function of at least one operating parameter, for example the load range, of the internal combustion engine, starting out from the further first position S100 shown in FIG. 2, into a further second position S200 (see FIG. 4), in which the eccentric shaft 13 extends the compression and expansion strokes relative to the intake and exhaust strokes by a greater amount.

With reference to FIG. 1, 5-7, a stroke adjustment is now explained, wherein the phase adjuster 100 is kept constant in its first position shown in FIG. 1, 5. Accordingly, the phase adjuster 100 can also be omitted in a modification that is not shown. In an embodiment, the phase adjustment explained above and the stroke adjustment explained in the following is or takes place combined with one another.

Figure 6:
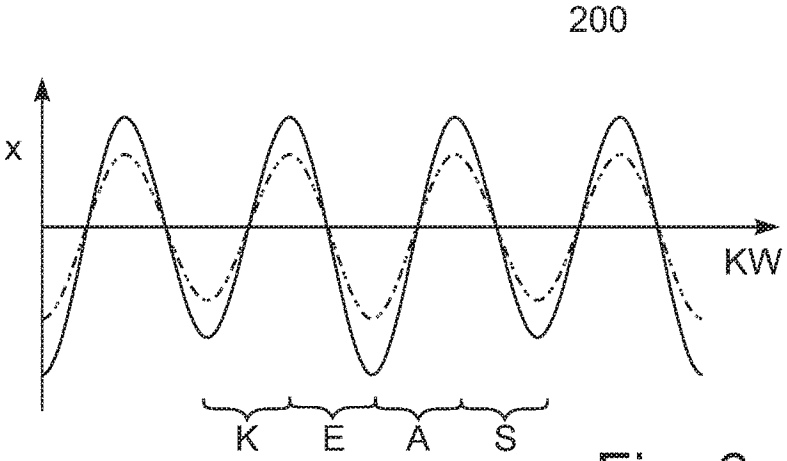
FIG. 6 is a graph showing strokes of the piston in the first position of FIG. 1 of the phase adjuster and the first position as well as the further position of the stroke adjuster.
Figure 7:
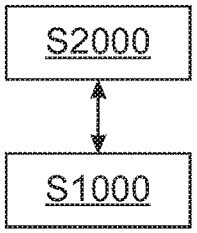
FIG. 7 is a flow chart showing a method for operating the internal combustion engine according to an embodiment of the present disclosure.

As is illustrated in particular by the comparison of FIG. 1, 5 and FIG. 6, the expansion, exhaust, intake and compression strokes are extended relative to the corresponding strokes in a further position of the stroke adjuster 200 shown in FIG. 5 through the shifting of the rotary joint 20 on the eccentric shaft 13 or the corresponding adjustment of the connection of second connecting rod 19 on eccentric shaft 13 or of the radius of the eccentric shaft 13, in which the same is connected to the second connecting rod 19, through the stroke adjuster 200 in its first position shown in FIG. 1.

Accordingly, the extension of individual strokes of the piston 2 within a cycle is also adjusted by the eccentric shaft 13 by the stroke adjuster 200.

In the first position S1000 (see FIG. 7) of the stroke adjuster 200 indicated in FIG. 1, the eccentric shaft 13 extends expansion strokes in expansion cycles E and exhaust strokes in exhaust cycles A relative to intake strokes in intake cycles S and compression strokes in compression cycles K, as explained above with reference to FIG. 1-4 and likewise indicated expanded in FIG. 6, in which analogously to FIG. 3 the movement x of the piston 2 over the crankshaft angle KW of the crankshaft 3 is indicated.

As a function of at least one operating parameter of the internal combustion engine, the ECU 120 steers the stroke adjuster 200 into the further position 52000 (see FIG. 7), which is indicated in FIG. 5. In this position, too, the eccentric shaft 13 extends expansion strokes in expansion cycles E and exhaust strokes in exhaust cycles A relative to intake strokes in intake cycles S and compression strokes in compression cycles K as indicated in dash-double dotted line in FIG. 6, however compared with the first position S1000, to a lesser extent.

As already emphasized multiple times, the phase adjustment described here and the stroke adjustment described here can be realized individually or, in an embodiment, be advantageously combined with one another which advantageously increases the flexibility (of the cycle process) of the internal combustion engine or its operation, in particular its control. Accordingly, depending on the operating state or parameters of the internal combustion engine, it is possible to change from the state of FIG. 2 into the state of FIG. 5, i.e. both phase and also strokes or their extension adjusted.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. An internal combustion engine for a motor vehicle, comprising:

a crankshaft;

a piston coupled to the crankshaft for performing strokes in a cylinder as a consequence of a rotation of the crankshaft;

an eccentric shaft coupled to the crankshaft and to the piston in such a manner that the strokes of the piston are extendable;

an adjustment mechanism selected from the group consisting of a phase adjuster configured to adjust a phase of a coupling of the eccentric shaft to the crankshaft, and a stroke adjuster configured to adjust an extension of the stroke of the piston by the eccentric shaft;

an adjustable crank drive operably coupling the crankshaft, the eccentric shaft and the piston;

the adjustable crank drive comprising a first connecting rod coupled to the piston, a second connecting rod coupled to the eccentric shaft and a coupling link coupled to the crankshaft and interconnecting the first and second connecting rods; and the adjustment mechanism comprising the stroke adjuster configured to adjust a length of at least one of the first connecting rod, the second connecting rod or the coupling link.

2. The internal combustion engine according to claim 1 further comprising a second piston coupled to the crankshaft for performing strokes in a second cylinder as a consequence of the rotation of the crankshaft, wherein the eccentric shaft is coupled to the crankshaft and to the second piston in such a manner that the strokes of the second piston are extendable.

3. The internal combustion engine according to claim 2 further comprising a second stroke adjuster configured to adjust an extension of the stroke of the second piston by the eccentric shaft.

4. The internal combustion engine according to claim 1, wherein the eccentric shaft is coupled to the crankshaft through a transmission.

5. The internal combustion engine according to claim 4, wherein the adjustment mechanism comprises the phase adjuster configured to adjust an offset of the between a first link and a second link of the transmission for adjusting the phase of the coupling of the eccentric shaft to the crankshaft.

6. The internal combustion engine according to claim 4, wherein the transmission comprises a positively joined traction drive.

7. The internal combustion engine according to claim 1, wherein the adjustment mechanism comprises the phase adjuster configured to adjust the eccentric shaft between an initial position for extending expansion and exhaust strokes relative to at least one of intake or compression strokes by a first amount and an further position for extending expansion and exhaust strokes relative to at least one of intake or compression strokes by a second amount which is greater than the first amount.

8. The internal combustion engine according to claim 1, wherein the adjustment mechanism comprises the phase adjuster configured to reduce a deviation between expansion, exhaust, intake and compression strokes by an amount less than or equal to 50% of a maximum deviation.

9. The internal combustion engine according to claim 1, wherein the adjustment mechanism comprises the stroke adjuster positionable in an initial position for extending expansion, exhaust, intake and/or compression strokes relative to expansion, exhaust, intake and/or compression strokes in a further position thereof.

10. The internal combustion engine according to claim 1, wherein the adjustment mechanism comprises the phase adjuster and the stroke adjuster.

11. The internal combustion engine according to claim 1, wherein each of the phase adjuster and the stroke adjuster are selected from the group consisting of a hydraulic adjustor or an electric adjuster.

12. The internal combustion engine according to claim 1, further comprising a turbocharger configured for supercharged filling of the cylinder.

13. The internal combustion engine according to claim 1, further comprising a controller configured to control the adjustment mechanism for adjusting at least one of the phase of the coupling of the eccentric shaft to the crankshaft, or the strokes of the piston as a function of at least one operating parameter, wherein the operating parameter is selected from the group consisting of a load range, a rotational speed, a torque, a temperature, a charge pressure or a combination thereof.

14. An internal combustion engine for a motor vehicle, comprising:

a crankshaft;

a first piston coupled to the crankshaft for performing strokes in a cylinder as a consequence of a rotation of the crankshaft;

an eccentric shaft coupled to the crankshaft and to the first piston in such a manner that the strokes of the first piston are extendable;

an adjustment mechanism selected from the group consisting of a phase adjuster configured to adjust a phase of a coupling of the eccentric shaft to the crankshaft, and a stroke adjuster configured to adjust an extension of the stroke of the first piston by the eccentric shaft;

a second piston coupled to the crankshaft for performing strokes in a second cylinder as a consequence of the rotation of the crankshaft, wherein the eccentric shaft is coupled to the crankshaft and to the second piston in such a manner that the strokes of the second piston are extendable; and a second stroke adjuster configured to adjust an extension of the stroke of the second piston by the eccentric shaft.

15. The internal combustion engine of claim 14, wherein the adjustment mechanism comprises the phase adjuster and the stroke adjuster.

16. An internal combustion engine for a motor vehicle, comprising:

a crankshaft;

a piston coupled to the crankshaft for performing strokes in a cylinder as a consequence of a rotation of the crankshaft;

an eccentric shaft coupled to the crankshaft and to the piston in such a manner that the strokes of the piston are extendable;

an adjustment mechanism selected from the group consisting of a phase adjuster configured to adjust a phase of a coupling of the eccentric shaft to the crankshaft, and a stroke adjuster configured to adjust an extension of the stroke of the piston by the eccentric shaft;

the adjustment mechanism comprising the phase adjuster configured to adjust the eccentric shaft between an initial position for extending compression and expansion strokes relative to at least one of intake or exhaust strokes by a first amount and a further position for extending compression and expansion strokes relative to at least one of intake or exhaust strokes by a second amount which is greater than the first amount.

17. The internal combustion engine of claim 16, wherein the adjustment mechanism comprises the phase adjuster and the stroke adjuster.

18. An internal combustion engine for a motor vehicle, comprising:

a crankshaft;

a piston coupled to the crankshaft for performing strokes in a cylinder as a consequence of a rotation of the crankshaft;

an eccentric shaft coupled to the crankshaft and to the piston in such a manner that the strokes of the piston are extendable;

an adjustment mechanism selected from the group consisting of a phase adjuster configured to adjust a phase of a coupling of the eccentric shaft to the crankshaft, and a stroke adjuster configured to adjust an extension of the stroke of the piston by the eccentric shaft;

the adjustment mechanism comprising the phase adjuster configured to adjust the eccentric shaft between an initial position for extending expansion and exhaust strokes relative to at least one of intake or compression strokes and a further position for extending compression and expansion strokes relative to at least one of intake or exhaust strokes.

19. The internal combustion engine of claim 18, wherein the adjustment mechanism comprises the phase adjuster and the stroke adjuster.

* * * * *